United States Patent [19]

Eigenmann

[11] 3,964,835

[45] June 22, 1976

[54] DEVICE FOR FORMING MARKING STRIPES ON ROAD SURFACES

[76] Inventor: Ludwig Eigenmann, Vacallo, Canton Ticino, Switzerland

[22] Filed: Apr. 13, 1973

[21] Appl. No.: 350,830

[30] Foreign Application Priority Data

Apr. 15, 1972 Italy ..... 23179/72

[52] U.S. Cl. ..... 404/94; 118/108; 118/415; 156/323; 156/526; 156/575; 156/577; 156/578; 259/8; 401/5; 401/48

[51] Int. Cl.[2] ..... B01F 7/00; E01C 23/16

[58] Field of Search ..... 156/523–526, 156/574, 575, 577, 323, 537, 578, 289; 404/94, 72, 93; 118/108, 415; 259/97, 8, 7; 427/136, 137; 401/5, 48

[56] References Cited

UNITED STATES PATENTS

| | | | |
|---|---|---|---|
| 770,912 | 9/1904 | Leavitt | 118/415 |
| 1,725,889 | 8/1929 | Thomasson | 118/415 |
| 2,898,825 | 8/1959 | Walker et al. | 404/94 |
| 3,005,624 | 10/1961 | Hoppe et al. | 259/8 |
| 3,007,838 | 11/1961 | Eigenmann | 156/575 |
| 3,070,822 | 1/1963 | Lipkins | 404/94 |
| 3,230,843 | 1/1966 | Santucci | 427/136 |
| 3,262,375 | 7/1966 | Eigenmann | 404/72 |
| 3,590,701 | 7/1971 | Broeck | 156/523 |
| 3,741,441 | 6/1973 | Eberle | 259/7 |
| 3,793,102 | 2/1974 | Day | 156/289 |

FOREIGN PATENTS OR APPLICATIONS

| | | | |
|---|---|---|---|
| 706,718 | 4/1954 | United Kingdom | 404/94 |

*Primary Examiner*—William A. Powell
*Assistant Examiner*—M. G. Wityshyn
*Attorney, Agent, or Firm*—Michael J. Striker

[57] ABSTRACT

There is described a device comprising, in combination with a wheel supported structure adapted to be moved on the road surface, an assembly having vertically elongated compartments for storage of long pot-life viscous components adapted to co-react when mixed together and to form promptly hardenable compounds adapted to form a layer on said road surface, to provide a sign thereon or to form a primer base for laying down and adhesively securing a tape thereto. The assembly also includes means for supporting and laying said tape on the freshly formed layer, as well as pneumatically operated motor and control means for controlling the movements and the sequence of operations of the device.

17 Claims, 7 Drawing Figures

Fig. 1
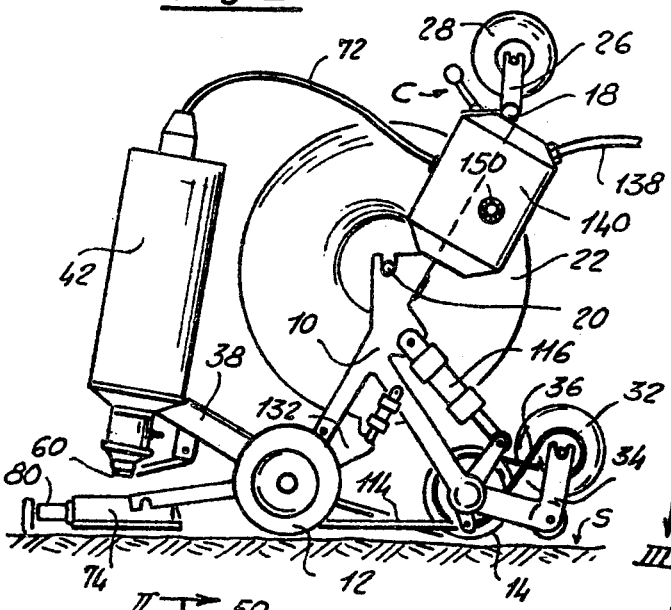
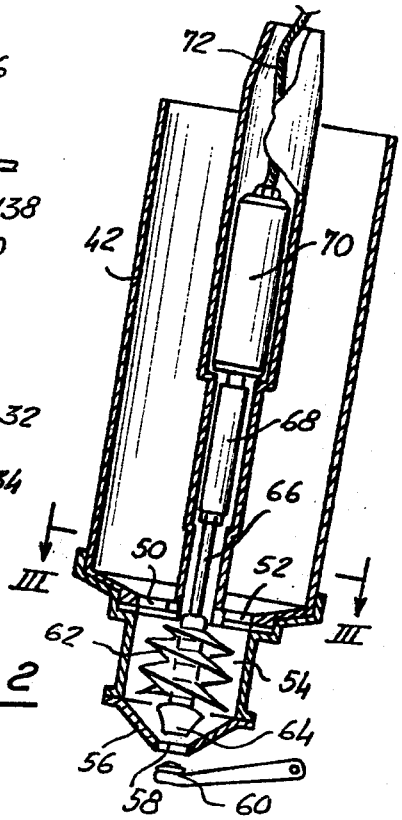
Fig. 2
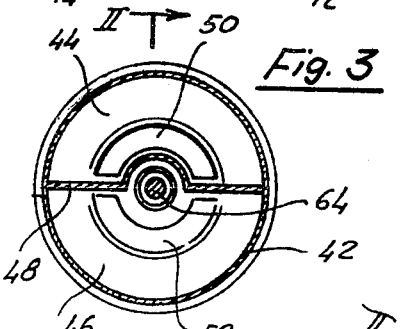
Fig. 3
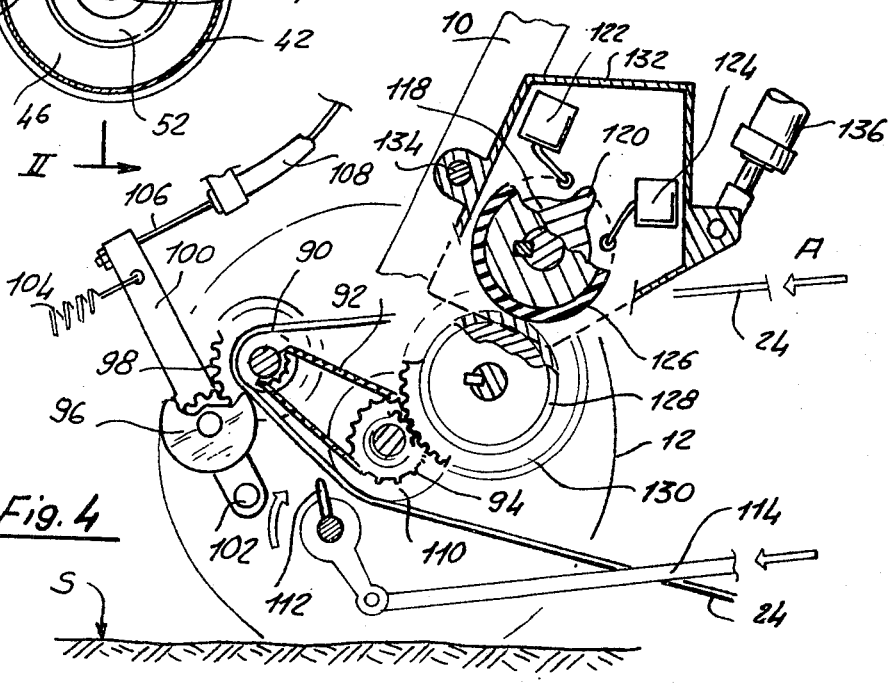
Fig. 4

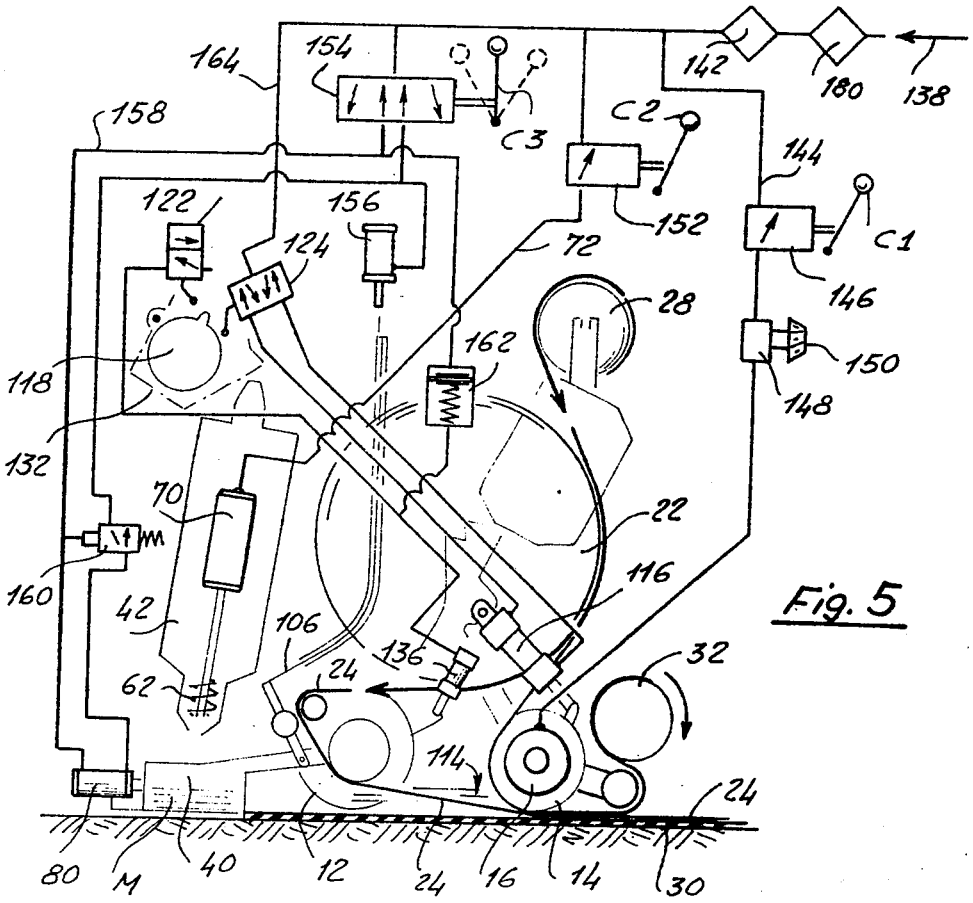
Fig. 5
Fig. 6
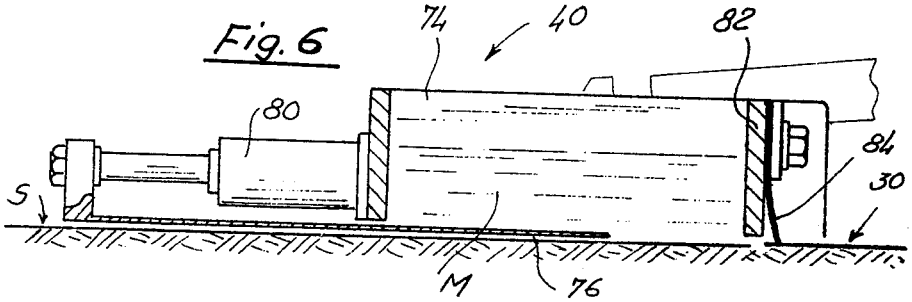
Fig. 7
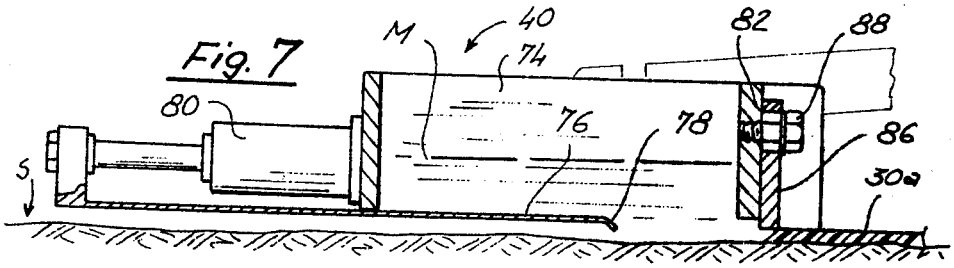

DEVICE FOR FORMING MARKING STRIPES ON ROAD SURFACES

BACKGROUND OF THE INVENTION

1. The Field of the Invention

The present invention relates to means for forming marking stripes and other traffic regulating signs on relatively flat surfaces, in particular on the paved surfaces of streets, highways and other areas, such as parking areas and the like, open to vehicle traffic. More particularly, this invention is concerned with a relatively simple, small but efficient device designed to provide, on said surface, a sidewardly defined and upwardly planar layer of a mark forming or marking tape-receiving compound capable of promptly setting as applied in layer form on such surfaces.

2. The prior Art

Marking stripes and equivalent signs on paved surfaces open to vehicle traffic are a traffic aid of paramount importance for traffic regulation and safety. The art of forming signs on such surfaces and areas is a well known one and no extensive discussion thereof is necessary. Broadly speaking, such stripes can be formed by making use of several methods, such as (*a*) by painting the stripe on a preliminarily cleaned and dried surface, (*b*) by forming on such surface a rather thick layer of a hardenable composition and adapted to form the sign by itself, and (*c*) by laying down and adhesively securing on said surface a tape of sign-forming material, generally of elasto-plastic nature. This latter and advantageous method is preferably complemented by preliminarily forming, on said surface, a tape receptive layer.

A rather wide patent literature illustrates such art. For example, mechanical means designed for laying down and adhesively securing a tape material to a prepared road surface have been described in the U.S. Pat. Nos. 3,007,838, 3,155,564 and 3,235,436 granted in the United States of America to the instant applicant. Some methods and means for providing on road surfaces a tape receptive layer have been described in the U.S. Pat. No. 3,262,375, also the instant applicant, who has also devised and made known certain improved structures of the tape material, such as described in his U.S. Pat. Nos. 3,399,607 and 3,587,415.

Certain problems relating to this art cannot however be said to have been completely solved. The conventional painted stripes and layers formed on streets and highways are disadvantageous in that it takes an appreciable amount of time for them to dry or completely set after they are painted or formed and they frequently become smeared or otherwise damaged before they have a chance to dry or set. The incomplete setting of a tape-receiving layer might lead to displacement of the tape when subjected to vehicle traffic shortly after being laid down. To provide a method and means capable of providing on a road surface a layer adapted either to form a sign by itself or to receive and have secured thereon and thereto a sign-forming tape, and capable of promptly setting on said surface, would evidently be a very desirable improvement in the art.

BRIEF SUMMARY OF THE INVENTION

It is therefore the object of this invention to provide a new and advantageous device by which a rapidly setting layer can be provided on a road surface. More particularly, the invention provides a device designed for forming, immediately or a short time before application to a road surface, a rapidly setting composition by mixing together two co-reacting components, which individually have a long pot-life in viscous but flowable state, and then laying the mixture on the road surface in regulated amounts and leveling the said mixture into layer form, this layer promptly drying and setting upon the reaction promoted by said mixing.

Consequently, the device according to the invention comprises container means including at least two storage chambers for individual storage of components capable of co-reacting when contacted with each other to form a rapidly setting mixture, a further chamber, individual passage means providing communication between said storage chambers and said further chamber, motor driven mixing and progressing means in said further chamber, a downwardly turned outlet at the bottom of said further chamber, through which a mixture formed in said further chamber can be ejected downwardly and in regulated amounts by said progressing means, an upwardly open box-like receptacle positioned beneath said outlet and having an operator-controlled movable bottom wall to form a passage communicating therewith as well as a rear side wall having a lower horizontal edge, and a wheel supported structure designed for displacement on a paved surface, supporting said container means and the said receptacle and positioning said receptacle adjacent said paved surface, whereby upon displacement of said structure on said surface a layer of said mixture, issuing through said bottom passage and levelled by said lower edge, is formed on said surface.

Preferably, the device is further adapted for laying down and pressing a tape material on the thus formed layer, and comprises means for rotatably supporting a bobbin of tape on the said structure, pressure roller means positioned for rolling engagement with the layer formed on the paved surface, and roller and guide means for guiding the tape during unwinding from said bobbin onto said layer below said pressure roller. Most preferably, the device further comprises cutter means for transversely cutting the tape at a location before the roller, when the tape-laying operation is to be discontinued, and means for operator-controlled advancement of the leading end of the cut tape until engagement with the formed layer and the roller when said operation is to be resumed. It is further preferable when, means are provided for concurrently activating and reactivating said means and opening and closing the said bottom passage for concurrently discontinuing and resuming the layer formation and tape application. It is also preferable when the device comprises pneumatically operated actuator means for actuating the several means of the device.

These and other features and advantages of the invention will be made apparent as this description proceeds, when taken in conjunction with the accompanying drawings.

THE SEVERAL VIEWS OF THE DRAWINGS

FIG. 1 is a somewhat simplified side elevation of the device;

FIG. 2 is a detailed sectional view of the mixture forming and ejecting mechanism, taken in the plane indicated at II—II in FIG. 3, which is a transverse sectional view of the mechanism, taken in the plane indicated at III—III in FIG. 2;

FIG. 4 is a rather diagrammatic view, partly in vertical section and partly in side elevation, of a group of gear and transmission means comprised in the device;

FIG. 5 is a diagrammatic illustration of the pneumatic circuits and actuators comprised in the device; and FIGS. 6 and 7 are longitudinal sectional views and partly side elevations of the layer forming receptacle, respectively adapted for forming a thin and a relatively thick layer on the paved surface.

DETAILED DESCRIPTION OF THE PREFERRED EMBODIMENT

Referring first to FIG. 1, the preferred embodiment of the device comprises a frame structure 10 provided with bearing wheels 12 for displacement of the device on a paved surface S, and a pressure roller 14 positioned to roll over the layer formed as described below. This roller acts as a driving wheel for the device and it is connected to a pneumatic motor 16 (shown in FIG. 5) in driving relationship preferably co-axial thereto. A transversely extending handlebar 18 is secured to the upper portion of the structure 10, for guiding of the device by an operator walking at the rear of the device and operating the various control means thereof, generally indicated at C in FIG. 1.

Said structure comprises also supports 20 on which a bobbin 22 of marking tape material can be rotatably supported, and from which a tape 24 can be unwound and guided below the roller 14 to be laid down as the device is displaced on the surface S, the direction of the displacement being from right to left, in the position shown in any FIGURES of the drawings. Suitably positioned braces 26 rotatably support another bobbin 28 of coiled thin sheet, such as a ribbon of thin polyethylene or polypropylene film. This ribbon is arranged to progress along the path indicated in FIG. 5, about and below the pressure roller 14, for protecting such roller from the freshly laid layer 30, to be subsequently taken up and re-wound on a bobbin 32 which is rotatably supported by a vertically oscillating rear part 34 of the frame structure, said bobbin being driven by a belt 36 actuated by a pulley co-axial with and secured to the pressure roller 14.

The compound designed to form the layer 30 (or **30*a*, FIG. 7) is formed and delivered by the subassembly supported by a brace 38 in front of the apparatus, and shown in detail in FIGS. 2 and 3. This assembly comprises a vertically elongated container 42 wherein two compartments 44 and 46 are formed by a partition wall 48. By means of arc-shaped passages 50 and 52 formed at the bottom of said compartments, a viscous but flowable material stored in each compartment and individually descend into a lower part of the subassembly, wherein a further chamber 54 is formed, having a frusto-conical bottom wall 56 and an axial outlet 58. A plug 60** is provided for manually closing said outlet.

Within said further chamber 54 a screw-type mixer 62 is co-axially arranged. Such mixer is secured to a plug component 64 adapted to close said outlet 58 when lowered therein. Said mixer 62 is driven, through a shaft 66 and an axially slidable coupling 68, by a small pneumatically operated motor 70 supplied with properly pressurized air via a hose 72. The said screw-mixer 62 is actuated to rotate, in accordance with the helical inclination of the screw, in a sense pushing the mixed compound formed in the chamber 54 downwardly and out through the outlet 58, while the axial reaction of the thrust applied to said compound raises said screw 62 and plug 64 to disengage said plug from said outlet 58, any time the motor 70 is activated.

A plurality of co-reactive components can be stored in the compartments 44 and 46, wherein said components, separately stored, possess a long pot-life, preparatory to being intimately mixed together in the chamber 54 to provide a rapidly setting compound. For example, such components may comprise cross-linkable chemicals, or one component may comprise a polymerizable chemical and the other a catalyst for promoting the polymerization. Various combinations of promoters and catalysts can be provided, to produce a mixture capable of prompt setting and hardening, according to the well-known art of providing paints, cements, adhesives and binders of the so called "two-component" type An upwardly open box-like receptacle 74 is positioned beneath the said outlet 58 from which the mixture or rapidly setting compound is caused to issue upon activation of motor 70. Such receptacle 74 is connected to the frame structure 10, by a pair of forwardly extending braces for example, in close proximity to and preferably in sliding relationship over the paved surface S. The details of this receptacle are shown in FIGS. 6 and 7. Said receptacle 74, which forms part of a subassembly indicated generally at 40, comprises a movable bottom wall consisting of a metal plate 76, which might be provided with a downwardly bent rear edge 78, as shown in FIG. 7, and which is lengthwise slidable between the side walls of the receptacle. The subassembly 40 also includes a pneumatic actuator 80 which is connected to said plate 76 for forwardly displacing the same as necessary to form a bottom passage, as shown in either FIGS. 6 and 7, so that the mixture, generally indicated at M in FIGS. 5 to 7, can reach at M in FIGS. 5 to 7, can reach and wet the surface S on which the sign is to be provided.

The rear wall 82 (in the direction of displacement of the device) of said receptacle has its lower edge well spaced above the surface S. The receptacle 74 shown in FIG. 6 is arranged for providing a thin layer 30 on the surface S, and a flexible doctor blade 84 is secured to said rear wall 82. This arrangement is useful for forming for example a painted stripe formed by a quick-drying two component paint, or for providing a planar layer of a prier or receptive compound adapted for receiving and adhesively securing a tape material. In the arrangement shown in FIG. 7, a vertically adjustable counter-wall 86 is secured, by means of bolts 88 passing through vertically elongated bores in said counter-wall, to said rear wall 82. By vertically adjusting said counter-wall, a layer **30*a* of the desired thickness can be formed. A relatively thick layer such as shown at 30*a*** may be formed with a rapidly hardenable composition adapted to form, by itself, the desired traffic regulating sign on a road surface, or to form a more consistent and planar base for receiving and adhesively securing a traffic regulating tape materiral, the latter being advantageous on rather worn road surfaces requiring a thick and impervious coating having a planar surface for properly securing a tape material thereon.

As above indicated, the preferred embodiment of the invention comprises means for operator-controlled discontinuation and resumption of the application of a tape material such as indicated at 24, for example when formation of a segmented lane dividing stripe is required. Such means comprise the mechanism shown in FIG. 4 and the pneumatic circuitry shown in FIG. 5, such mechanism and circuitry being complementary to each other and the said FIGS. 4 and 5 to be jointly considered.

Considering the path along which the tape 24 is guided in direction A, said tape is passed about a guide roller 90 which acts also as a driving pulley, when necessary, and is rotated by a transmission chain 92 driven by a sprocket gear 94 keyed to one of the bearing wheels 12. Said roller 90 has a gear 98 secured thereto, which is in mesh with a driven gear secured to a counter-roller 96, rotatably supported by a lever 100 pivoted at 102 to the frame structure 10 and biased by a spring 104 in such a direction as to space the counter-roller 96 from the roller 90, so that the tape 24 can slide about the latter roller without being pressed against it. Such lever 100 can however be moved say by a flexible wire 106 sliding in a flexible sheath 108, according to a well-known arrangement, so as to press the counter-roller 96 against the roller 90 and thus provide a positive frictional engagement for advancing the tape in direction A until the same is engaged below the pressure roller 14 (FIG. 1).

Co-axially with the wheels 12 another roller 110 is supported, and forms a guide for the tape 24 as well as the anvil for a cutter blade 112 which can be urged against and into the tape 24, for transversely cutting the same, upon action exerted, through lever means and a connecting rod 114, by another pneumatic actuator 116 (FIGS. 1 and 5).

The phased relationship between the various actions is provided by the cooperation of a cam 118 having a projection 120 which, upon rotation of the cam, successively engages actuator levers of valves 122 and 124 comprised in the pneumatic circuitry of FIG. 5. The rotation of the cam 118 is provided by the frictional engagement of a driven friction pulley 126 on a driving pulley 128, which is, in turn, driven by gearing 130 connected to one bearing wheel 12. The said cam, valves and driven pulley (the components indicated at 118 to 128) are supported in a gear box 132 pivotally connected at 134 to the frame structure 10 and connected to a further pneumatic actuator 136 so that the said pulleys 126 and 128 can be frictionally engaged and disengaged from each other.

As shown in FIg. 5 (wherein the box 132, cam 118 and valves 122 and 124 are located offset from their actual position of FIG. 4, for purposes of illustration), the device is operated by pressurized air (provided by a conventional compressor, not shown), supplied through a suitable hose, the last part of which is indicated at 138 in FIGS. 1 and 5, and it includes pneumatic circuitry with several components, a part of the circuitry being located in and protected by an enclosure 140 (FIG. 1) secured to the frame structure.

Upon passage through a known filter 180 and a known lubricator 142, the pressurized air is supplied to several valve means. A first operator-controlled (by a control lever C1) valve 146 is connected to the supply by a duct 144. Upon opening of the valve 146 the air is fed to the motor 16 for driving the roller 14 thus displacing the device on the road surface. The speed of the displacement can be adjusted by adjusting the pressure via actuation of the control knob 150 of a known pressure regulator 148. The activation of the motor 70 of the mixer 62 of the mechanism shown in FIGs. 2 and 3 is also individually controlled by the operator, who acts on the control lever C2 of a second valve 152, the outlet of which is connected to said hose 72.

By means of a third control lever C3 a multiple valve 154 is controlled for initiating and discontinuing the tape-laying operations. When said lever C3 and valve 154 are set and maintained in their center positions (as shown) the circuitry maintains the device in its actually set condition, that is either in its tape-laying condition or in the condition where tape-laying has been discontinued.

When this control lever C3 and valve 154 are set in their left-hand position, a small actuator 156 is activated and pulls the transmission wire 106 to cause the counter-roller 96 to engage the tape 24 and cause the same to be advanced until engaged below the pressure roller 14. Concurrently, via a duct 158, the pressure is applied to the actuator 80 which opens the bottom 76 of the receptacle 74, so that the tape-laying operation is promoted concurrently with the laying down of the layer 30 or **30*a* designed to form the base for said tape. Upon firm engagement of the tape under the roller 14, the operator can return the said control lever and valve to their center position, while a valve 160, controlled by the pressure supplied to the duct 158, maintains the actuator 80** in its "bottom open" position.

When the laying down of the tape is to be discontinued, the control lever C3 and the valve 154 are temporarily set in their right-hand position. The duct 158 is vented and the other duct, connected to the opposite end of the actuator 80, is pressurized to cause the closure of the bottom of the receptacle so that the layer formation is discontinued. Concurrently, a cylinder 162 is pressurized to supply a regulated amount of pressurized air to the actuator 136 and to the inlet of a normally closed valve 122. The actuator displaces the box 132 to cause the engagement of the friction pulleys 126 and 128 and thus the rotation of cam 118. The projection of the cam engages first the control arm of a double valve 124, whose inlet is connected to the supply, via a duct 164, to pressurize the actuator 116 which operates the cutter 112 and causes the cutting of the tape 24. After a brief time, the cam acts on the control lever of the other valve 122, which vents the actuator 136 and the cylinder 162, thus causing both the disengagement of friction pulleys 126, 128 and that of the counter-roller 96 from roller 90.

As a consequence of the above action, the laying down of the tape is discontinued also, concurrently with the discontinuation of the formation of the layer 30 or **30*a*. The mechanisms included in and associated with the box 132 (the components 118 to 124) are provided for ensuring a slight delay in the discontinuation of the formation of the layer 30 or 30*a*** relative to discontinuation of the tape-laying operation. As a matter of fact, the said layer formation must slightly precede the laying down of the tape, and said formation must be discontinued with a certain delay in order to assure that every segment of the tape laid down will have a proper primer layer to be pressed upon and adhesively secured to.

The foregoing description is primarily for explanatory purposes, and is given to illustrate a specific embodiment of the invention. It is understood that many variations in the structure, design and arrangement of the various elements of the stripe application apparatus will occur to one skilled in the art. Accordingly, it is understood that such changes and modifications of the invention illustrated and described above may be made within the scope of the appended claims without departing from the spirit of the invention.

I claim:

1. A road-marking device, comprising a vehicle for displacement over a road surface; container means mounted on said vehicle and including at least two compartments for separately confining different viscous components of a composition to be applied over the road surface; mixing means on said vehicle for mixing said viscous components so as to form said composition prior to application of the latter over the road surface, said mixing means comprising a mixing chamber having a downwardly facing outlet and located below and adapted to communicate with said compartments so as to permit descent of said viscous components into said mixing chamber by gravity, and said mixing means further comprising a rotary elongated mixer mounted for axial displacement in said mixing chamber and having a plug member at an end of said elongated mixer adjacent said outlet for closing the same when said mixer is stationary, said mixer having helically-arranged screw flights each having an inclined bottom surface extending generally radially in a sense away from said outlet, said inclined bottom surfaces being operative for pushing said mixer axially away from said outlet so as to open the same and permit the ejection of the resulting viscous composition as a function of the reaction force exerted by said viscous composition upon the inclined bottom surfaces during rotation of said mixer; a receptacle mounted on said vehicle below said outlet for receiving said composition and including a member movable between an open position in which the interior of said receptacle communicates with the road surface so as to permit application of said composition over the latter and a closed position, said receptacle having a trailing wall and also including doctor blade means on said wall for forming from said composition a layer of predetermined thickness over the road surface after application of said composition over the latter, said doctor-blade means including means for adjusting the vertical position thereof with respect to the road surface; support means on said vehicle for rotatably supporting at least one strip of marking material adapted to be applied over said layer; guide means for guiding said strip during application thereof over said layer; and pressure roller means positioned on said vehicle upstream of said receptacle as considered with respect to the direction of displacement of said vehicle over the road surface so as to pass over said composition subsequent to formation of said layer over the road surface.

2. A device as defined in claim 1, wherein said mixer is arranged in said mixing chamber substantially coaxially with said outlet; and wherein said plug member is coaxially arranged with an end of said mixer adjacent said outlet so as to permit closure of said outlet when said mixer is stationary.

3. A device as defined in claim 1, said receptacle having a bottom wall located above the road surface adjacent thereto; and wherein said movable member is constituted by said bottom wall.

4. A device as defined in claim 1, said receptacle having said trailing wall provided with a lower edge and positioned at a downstream location of said receptacle with respect to the direction of displacements of said vehicle; and wherein layer forming means is constituted by said lower edge.

5. A device as defined in claim 1; further comprising a pnematic actuator for said movable member; and valve means actuable by an operator of said vehicle for controlling said actuator and movement of said movable member between said open and closed positions.

6. A device as defined in claim 1; further comprising rotatable supply means for supporting an impervious ribbon and supplying the same to a location between said pressure roller means and said strip upstream of said pressure roller means; rotatable take-up means for receiving said ribbon after passage of said pressure roller means over the latter; and drive means for advancing said ribbon from said supply means to said take-up means.

7. A device as defined in claim 1; further comprising pneumatic first motor means for driving said mixer; pneumatic second motor means for effecting displacement of said vehicle over the road surface; valve means actuable by an operator of said vehicle and including a first valve and a separate second valve; and conduit means adapted to be connected with a source of pressurized air and connecting said first and second motor means with said first and second valves, respectively, so as to permit formation of said composition independently of the displacement of said vehicle.

8. A device as defined in claim 1; further comprising cutting means actuable by an operator of said vehicle and operative for cutting said strip at a location upstream of said pressure roller means; and a driven roller engageable with said strip upstream of said cutting means for positively advancing said strip into engagement with said layer.

9. A device as defined in claim 8; further comprising pneumatic actuator means for effecting engagement and disengagement of said driven roller and said strip, for activating said cutting means and for effecting displacement of said movable member between said open and closed positions; means defining a circuit for pressurized air and adapted to be connected with a source of pressurized air; valve means in said circuit defining means actuable by an operator of said vehicle and effective for permitting activation of said cutting means and concurrent movement of said movable member from said open to said closed position when application of said composition and said strip over the road surface is to be terminated and for permitting engagement of said roller means and said strip and concurrent movement of said movable member from said closed to said open position when application of said composition and said strip over the road surface is to be initiated; and delaying means for delaying application of said strip over the road surface until application of said composition over the road surface has been initiated.

10. A device as defined in claim 9, wherein said delaying means comprises a transmission which includes a pair of pulleys relatively movable between a position wherein said pulleys are in engagement with one another and a position wherein said pulleys are disengaged from one another, one of said pulleys being a driving pulley mounted for rotation in conjunction with the displacement of said vehicle over the road surface and the other of said pulleys being driven by said driving pulley, said actuating means being operative for effecting relative movement of said pulleys, and said delaying means further comprising rotatable cam means connected with said other pulley, and a pair of valves positioned so as to be sequentially activated by said cam means, one of said valves being operative for permitting activation of said cutting means and the other of said valves being operative for permitting disengagement of said pulleys from one another.

11. A road-marking device, comprising a vehicle for displacement over a road surface; pneumatic first motor means for effecting displacement of said vehicle over the road surface; container means mounted on said vehicle and including at least two compartments for separately confining different viscous components of a composition to be applied to the road surface; mixing means on said vehicle for mixing said viscous components so as to form said composition prior to application of the latter over the road surface, said mixing means comprising a mixing chamber adapted to communicate with said compartments and having a downwardly facing outlet, and said mixing means further comprising a rotary elongated mixer mounted for axial displacement in said mixing chamber and having a plug member at an end of said elongated mixer adjacent said outlet for closing the same when said mixer is stationary, said mixer having helically-arranged screw flights each having an inclined bottom surface extending generally radially in a sense away from said outlet, said inclined bottom surfaces being operative for pushing said mixer axially away from said outlet so as to open the same and permit the ejection of the resulting viscous composition as a function of the reaction force exerted by said viscous composition upon the inclined bottom surfaces during rotation of said mixer; pneumatic second motor means for driving said rotary mixer independently of the displacement of said vehicle over the road surface by said first motor means; a receptacle mounted on said vehicle below said outlet for receiving said composition and including a member movable between an open position in which the interior of said receptacle communicates with the road surface so as to permit application of said composition over the latter and a closed position, said receptacle also including means for forming from said applied composition a layer of predetermined thickness over the road surface; support means on said vehicle for rotatably supporting at least one strip of marking material adapted to be applied over said layer; cutting means for cutting said strip; roller means engageable with said strip for positively advancing said strip into engagement with said layer; pneumatic actuating means including a first actuator for said roller means so as to permit engagement of the latter and said strip, a second actuator for said cutting means and for effecting disengagement of said roller means and said strip, and a third actuator for said movable member; delaying means for delaying application of said strip over the road surface until application of said composition over the road surface has been initiated, said delaying means comprising a transmission which includes a pair of pulleys relatively movable between a position whereby said pulleys are in engagement with one another and a position wherein said pulleys are disengaged from one another, one of said pulleys being a driving pulley mounted for rotation in conjunction with the displacement of said vehicle over the road surface and the other of said pulleys being driven by said driving pulley, said second actuator being operative for effecting relative movement of said pulleys, and said delaying means further comprising rotatable cam means connected with said other pulley, and a pair of valves positioned so as to be sequentially activated by said cam means, one of said valves being operative for permitting activation of said cutting means and the other of said valves being operative for permitting disengagement of said pulleys from one another; means defining a circuit for pressurized air and adapted to be connected with a source of pressurized air, said circuit defining means communicating with said motor means, said actuating means and said valves; and valve means in said circuit defining means actuatable by an operator of said vehicle, said valve means including a first valve for permitting actuation of said cutting means and concurrent movement of said movable member from said open to said closed position when application of said composition and said strip over the road surface is to be terminated and for permitting engagement of said roller means and said strip and concurrent movement of said movable member from said closed to said open position when application of said composition and said strip over the road surface is to be initiated, and said valve means further including a second valve for permitting activation of said first motor means, and a third valve for permitting activation of said second motor means.

12. A device as defined in claim 11, wherein said mixer is arranged in said mixing chamber substantially coaxially with said outlet and wherein said plug member is coaxially arranged with an end of said mixer adjacent said outlet so as to permit closure of said outlet when said mixer is stationary.

13. A device as defined in claim 11, said receptacle having a bottom wall located above the road surface adjacent thereto; and wherein said movable member is constituted by said bottom wall.

14. A device as defined in claim 11, said receptacle having a wall provided with a lower edge and positioned at a downstream location of said receptacle with respect to the direction of displacement of said vehicle; and wherein said layer forming means is constituted by said lower edge.

15. A device as defined in claim 11, wherein said mixing chamber is located below said compartments so as to permit descent of said components into said mixing chamber by gravity.

16. A device as defined in claim 11, and further comprising guide means for guiding said strip during application thereof over said layer.

17. A device as defined in claim 11; and further comprising pressure roller means positioned so as to pass over said composition subsequent to formation of said layer over the road surface; rotatable supply means for supporting an impervious ribbon and supplying the same to a location between said pressure roller means and said strip upstream of said pressure roller means; rotatable take-up means for receiving said ribbon after passage of said pressure roller means over the latter; and drive means for advancing said ribbon from said supply means to said take-up means.

* * * * *